US008221025B2

(12) United States Patent
Buschmann et al.

(10) Patent No.: US 8,221,025 B2
(45) Date of Patent: Jul. 17, 2012

(54) METHOD FOR LAYING A PAVING MAT

(75) Inventors: Martin Buschmann, Neustadt (DE); Roman Munz, Neustadt (DE)

(73) Assignee: Joseph Vögele AG, Ludwigshafen/Rhein (DE)

( * ) Notice: Subject to any disclaimer, the term of this patent is extended or adjusted under 35 U.S.C. 154(b) by 397 days.

(21) Appl. No.: 12/610,675

(22) Filed: Nov. 2, 2009

(65) Prior Publication Data

US 2010/0150650 A1 Jun. 17, 2010

(30) Foreign Application Priority Data

Dec. 16, 2008 (EP) ..... 08021843

(51) Int. Cl.
*E01C 23/06* (2006.01)

(52) U.S. Cl. ..... 404/75; 404/84.8

(58) Field of Classification Search ..... 404/75, 404/84.1, 84.8, 96, 104
See application file for complete search history.

(56) References Cited

U.S. PATENT DOCUMENTS

| | | | | |
|---|---|---|---|---|
| 4,823,366 | A * | 4/1989 | Williams | 377/2 |
| 5,044,820 | A * | 9/1991 | Prang | 404/84.1 |
| 5,356,238 | A * | 10/1994 | Musil et al. | 404/84.1 |
| 5,549,412 | A * | 8/1996 | Malone | 404/84.1 |
| 5,568,992 | A | 10/1996 | Grembowicz et al. | |
| 6,890,125 | B1 * | 5/2005 | Calder et al. | 404/104 |
| 6,916,070 | B2 * | 7/2005 | Sehr | 299/1.5 |
| 7,172,363 | B2 * | 2/2007 | Olson et al. | 404/75 |
| 7,654,769 | B2 * | 2/2010 | Herrmann | 404/75 |
| 8,079,776 | B2 * | 12/2011 | Lossow | 404/84.5 |

FOREIGN PATENT DOCUMENTS

DE 2709435 A1 9/1978

* cited by examiner

*Primary Examiner* — Gary S Hartmann
(74) *Attorney, Agent, or Firm* — Fish & Richardson P.C.

(57) ABSTRACT

According to a method for laying a paving mat with a paving screed, the paving mat comprising a lane and a downwardly inclined slope beginning at a transition to the outside, the paving screed comprising a base screed and at least one extension screed which is extendable and retractable by a sliding motion in a sliding direction parallel to the base screed for varying the working width of the paving screed, the base screed and the extension screed having sole plates at the lower sides, with the sole plate of the extension screed being inclined laterally for forming the slope with the angle of the slope, a lateral position of the transition is first set relative to the base screed, during or after setting the lateral position a height difference is measured perpendicular to the planum between a fixed measuring location at the base screed and a location along a reference line extending parallel to the sole plate of the extension screed, the measured height difference being converted into a target value, and in the case of a variation of the working width and/or of the angle an occurring deviation of the height difference from the target value as caused by the variation is measured and automatically is corrected by a simultaneous height adaptation of the sole plate of the extension to the target value in order to maintain the set lateral position of the transition stationary.

11 Claims, 3 Drawing Sheets

METHOD FOR LAYING A PAVING MAT

BACKGROUND OF THE INVENTION

The invention relates to a method for laying a paving mat of paving material on a planum with a paving screed being towed floatingly in travelling direction on the paving material by a road paver, the paving mat comprising a lane of a determined width and at least one sideward slope, the slope being inclined downwardly from a transition into the lane, the paving screed including a base screed and at least one extension screed which is mounted at the front side or the rear side of the base screed and is slidable lateral to the travelling direction substantially parallel to the base screed for varying a working width, the base screed and the extension screed having respective sole plates, the sole plate of the extension screed being inclined laterally at the angle of the slope relative to the sole plate of the base screed, according to which method in the case of a variation of the working width by sliding the laterally inclined extension screed relative and parallel to the base screed and/or in the case of a variation of the angle of the slope by laterally tilting the sole plate of the extension screed relative to the sole plate of the base screed, in order to maintain the predetermined lateral position of the transition stationarily. The sole plate of the extension screed is adjusted in height direction relative to the base screed by means of at least two height adjustment assemblies which are distant from each other in sliding direction of the extension screed. The method is characterised by the following steps:

during or after setting the lateral position a height difference is measured substantially perpendicular to the planum between a fixed measuring location at the base screed and a location along a reference line fixed at the extension screed, which reference line is parallel to the laterally inclined extension screed and the slope, the measured height difference is stored as a target value, a deviation of the height difference from the target value caused by the variation is measured while the paving material is laid, and the deviating height difference is corrected to the target value exclusively by an automatic height adaptation of the sole plate of the laterally inclined extension screed by actuating the height adjustment assemblies corresponding to the measured deviation.

According to the method known from U.S. Pat. No. 5,568,992 A both height adjustment assemblies of the extension screed, which height adjustment assemblies are provided for adjusting both the height position of the sole plate of the extension screed and the angle of the slope, are actuated with complicated calculation operations for which linear position signals of both height adjustment assemblies and of a sliding drive of the extension screed are processed in combination with input target positions in order to maintain the lateral position of the transition with respect to the base screed stationary. When carrying out these calculation operations even signals of angle sensors are considered which detect the angle of attack of the paving screed and the angle of the inclination of the road paver relative to the planum. As, according to the known method, simultaneously a plurality of information has to be evaluated and processed, the regulating system used to carry out the method is complicated and prone to failure.

According to a method known from DE-U-92 11 854 the sole plate of the extension screed is automatically maintained aligned with the sole plate of the base screed at a respective correct height position corresponding to the respective angle of attack of the paving screed relative to the planum, such that longitudinal steps are avoided in the surface of the paving mat.

According to the method known from DE-27 09 435 C the height adjustment assemblies provided in the extension screed are used both for a height adjustment and for adjusting the lateral inclination of the sole plate of the extension screed. Adjustments of the lateral inclination are executed for forming crown profiles of the paving mat surface. The height adjustment assemblies contain screw spindles or hydro-cylinders which can be remotely actuated independent from the angle of attack of the paving screed.

During the production of the paving mat continuously extending over the working width of the paving screed the working width is varied by sliding the extension screed along the base screed. The angle of attack of the paving screed relative to the planum influences the thickness of the paving mat and can be varied or is varied. A variation of the angle of attack of the paving screed needs to correspondingly adapt the height position of the rear edge of the sole plate of the extension screed relative to the rear edge of the sole plate of the base screed. A laterally varying mat thickness is adjusted by different height positions of the towing points of the towing bars of the paving screed at the road paver. Among others paving mats frequently laid in Northern America have a lane of predetermined width and at least one sideward laterally inclined slope. In this case the sole plate of the extension screed is inclined laterally to the travelling direction. As in the case of a variation of the working width normally the width of the lane should not vary, it is important to then maintain the lateral position of the transition between the lane and the slope relative to the base screed stationary.

It is an object of the invention to provide a method allowing to reliably maintain the lateral position of the transition with respect to the base screed stationary, and which only needs to process a minimum amount of information.

According to the invention when determining or after determining the lateral position a height difference is measured substantially perpendicular to the planum P and between a fixed measuring member located at the base screed and a location along a reference line at the extension screed, which reference line is parallel to the sole plate of the laterally inclined extension screed and the slope. The height difference is stored as a target value. In the case of a variation of the working width and/or of the angle of the slope a deviation of the height difference from the target value caused by the variation is then measured. The deviating height difference then is corrected to the target value solely by an automatic height adaptation of the laterally inclined extension screed by means of the height adjustment assemblies corresponding to the measured deviation of the sole plate.

According to this method exclusively a height measurement has to be carried out in order to detect the height position of the sole plate of the extension screed relative to the sole plate of the base screed. The lateral position of the transition between the lane and slope first is fixed by e.g. adjusting the height position and/or the lateral inclination of the sole plate of the extension screed so that the lateral position will be situated at a desired location relative to the base screed. With the help of the fixed lateral position the height difference is measured perpendicular to the planum and is converted to a target value. In the case of a variation of the working width and/or of a variation of the angle of the slope needed while the paving mat is laid height measurements are carried out. Then only a detected deviation from the target value resulting from the variation is used to carry out a height adjustment of the sole plate of the extension screed so that the lateral position is maintained stationarily. This results in a reliable method for maintaining the lateral position of the transition. It is only necessary to obtain, evaluate and process a minimum amount of information, namely only the height difference.

Expediently the height difference and/or the deviation from the target value is measured by a measuring member of a height measuring device, the measuring member being fixed at the base screed. The measuring member measures reliably irrespective of the momentary sliding position of the extension screed at the base screed, and directly delivers the information which is needed for the actuation of the height adjustment assembly in order to automatically maintain the lateral position stationary.

OBJECTS OF THE INVENTION

Alternatively, the height difference and/or the deviation of the height difference is measured by a height measuring device having a measuring member which can move in height direction relative to the fixed measuring location at the base screed. The measuring member directly delivers the height difference information by its movement in height direction while sliding along the reference line which moves in relation to the measuring member when the extension screed slides in relation to the base screed, while the measuring member is held in sliding direction of the extension screed relative to the base screed. The reference line being parallel to the sole plate of the extension screed moves during a sliding motion of the extension screed relative to the measuring member which is sliding on the reference line and dislocates the measuring member in height direction, such that the height difference is directly detected.

Expediently the height difference is respectively measured at or close to the end of the sole plate of the base screed which end is associated to the extension screed. By doing this imprecise measurements are avoided which could be caused by e.g. deformations of the components which are moved in relation to each other. Furthermore, this is expedient in the case of a paving screed the extension screed of which is mounted at the rear side of the base screed, because in this case the lateral position of the transition always has to be maintained at the outer end of the sole plate of the base screed to which the extension is associated.

Favourably the height difference is measured at or close to the rear edge, rear in travelling direction, of the sole plate of the extension screed or the sole plate of the base screed. This is of advantage because the rear edge of the respective sole plate is that part of the paving screed finally defining the surface of the paving mat.

Expediently a ruler is provided at the extension screed or at the sole plate of the extension screed as the reference line. The ruler is stationarily fixed there. The height difference may be measured mechanically by means of the measuring member which is provided at the base screed and which supplies an actuation signal for the height adjustment assemblies in the extension screed. The measuring member may be formed as a height feeler. Even small deviations from the target value of the height difference are detected reliably mechanically and are converted in a corresponding actuation signal. Such a mechanically operating height feeler is structurally simple, cheap, robust and reliable.

Alternatively the height difference may be measured without contact by means of at least one measuring member built as an electronic height sensor. The measured height difference or the deviation from the target value may be converted by the height sensor or via a conversion circuitry into the actuation signal for the height adjustment assemblies in the extension screed. The electronic height sensor may operate on an optoelectronic base, with radar, ultrasound or according to another principle.

As the angle of the slope normally does not amount to more than about 10° or the inclination normally does not amount to more than about 10%, during a sliding displacement of the extension screed only relatively small deviations from the target value of the height difference will occur. In order to even detect such small deviations reliably, the height measuring device may be designed such that the measured deviation is converted or amplified to a larger value in order to properly actuate the height adjustment assemblies of the extension screed even in case of a small variation of the working width and/or of the angle of the slope.

Expediently the linear speed of the sliding displacement of the extension screed in sliding direction parallel to the base screed and the linear speed of the height adjustment of the sole plate of the extension screed at least substantially perpendicular to the planum are matched with each other taking into consideration the set angle of the slope or a trigonometric function of this angle, preferably of the tangent of the angle, such that the lateral position of the transition is maintained stationary even in the case of only a small variation of the working width.

If the deviation from the target value of the height difference is not be completely corrected by the automatic height adjustment of the sole plate of the extension screed, an additional correction can be carried out manually or remotely controlled. The operator of the road paver or personnel present in the vicinity of the paving screed then may easily detect a sideward drift of the transition between the lane and the slope directly by a visual check and can then, so to speak, intervene and to overrule the automatic regulation.

In the case of a paving screed having the respective extension screed at the rear side of the base screed the lateral position of the transition is maintained substantially at the end of the sole plate of the base screed which is associated to the respective extension screed, in order to avoid paving material tending to be collected in a dead space occurring between the base screed and the extension screed. Such accumulated paving material in the dead space may cause unevenness in the surface of the paving mat.

In the case of a paving screed having the respective extension screed is mounted at the front side of the base screed, to the contrary, the lateral position of the transition may be chosen and maintained at each arbitrarily selected location between the end of the sole plate of the base screed which end is associated to the respective extension screed and the middle of the base screed. In the case of this paving screed the danger of a dead space between the extension screed and the base screed does not occur where paving material could be accumulated because the extension screed is working the paving material in travelling direction ahead of the base screed.

BRIEF DESCRIPTION OF THE DRAWINGS

Embodiments of the invention will be explained with the help of the drawing. In the drawing is.

DETAILED DESCRIPTION OF THE INVENTION

Figure 1:
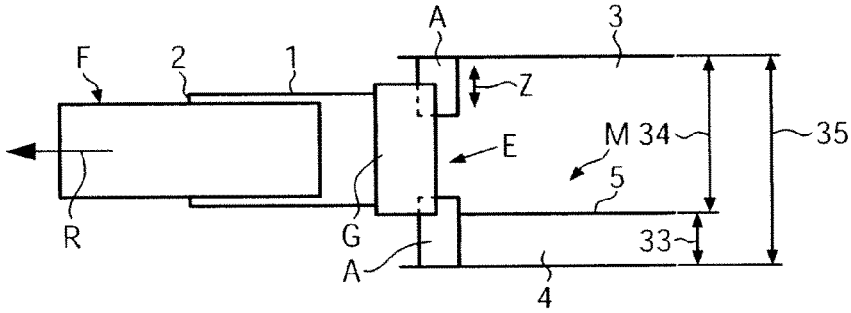
FIG. 1 a schematic top view of a road paver and of a towed paving screed while laying a paving mat, the paving screed having a base screed and extension screeds which are slidably provided at the rear side of the base screed, FIG. 2 a schematic top view of a road paver and of a towed paving screed while laying a paving mat, the paving screed having extension screeds mounted to the front side of the base screed, FIG. 3 a schematic side view of the road paver of FIG. 1, FIG. 4 a schematic side view of the road paver of FIG. 2, FIG. 5 a rear view of the road paver of FIG. 1, FIG. 6 a rear view of the road paver of FIG. 2, FIG. 7 a rear view of the paving screed e.g. of the road paver of FIGS. 1, 3 and 5 in larger scale and detailed illustration, and FIG. 8 a perspective view of the paving screed shown in FIG. 7 in viewing direction from the left rear upper side.
Figure 3:
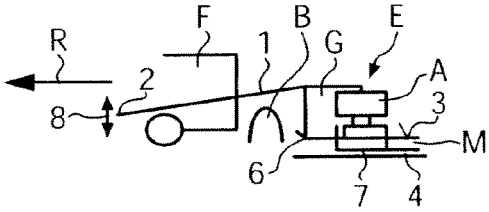
Figure 5:
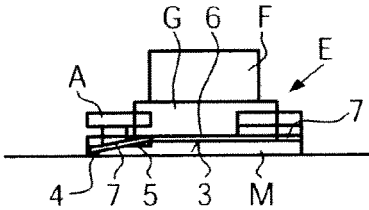

FIGS. 1, 3 and 5 show a respective road paver F travelling in travelling direction R while laying a paving mat M having a working width 35 on a planum P. The working width 35 is variable depending on the local roadbed conditions. The road paver F tows at towing points 2 via towing bars 1 a paving screed E on paving material B (bituminous paving material or concrete paving material). The paving screed E comprises a base screed G of fixed base screed width and two extension screeds A, which are arranged at the rear side (in travelling direction R) of the base screed G. The extension screeds A are slidable in a sliding direction Z parallel to the base screed G in order to vary the working width 35. The laid paving mat M consists of a planar lane 3 of predetermined width 34 (alternatively not planar but with a crown profile, not shown) and a sideward downwardly obliquely inclined slope 4 of a width 33. The width 33 varies depending on variations of the working width 35 as the lane 3 has the predetermined width 34. The slope 4 starts at a transition 5 and descends under a predetermined angle $\alpha$. The slope 4 e.g. is formed by one of the extension screeds A. The base screed G has at the lower side a sole plate 6. Each extension screed A has at the lower side a sole plate 7. The sole plate 7 of the extension screed A forming the slope 4 is obliquely inclined at the angle $\alpha$ such that the transition 5 is positioned at that end of the sole plate 6 of the base screed G which is associated to the extension screed A forming the slope 4. Furthermore, each sole plate 7 is adjustable in its height position in the extension screed A.

Figure 2:
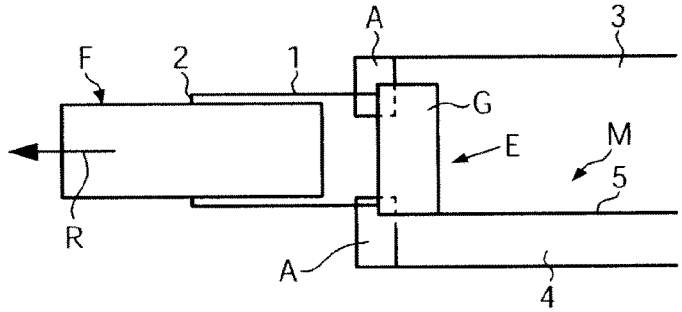
Figure 4:
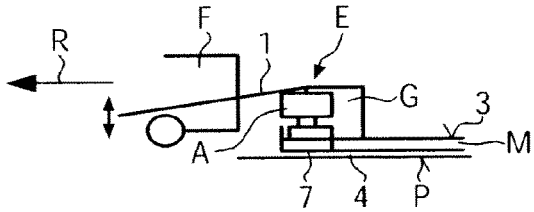
Figure 6:
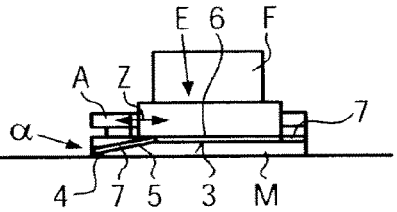

In the case of the paving screed E indicated in FIGS. 2, 4 and 6, having the extension screed A mounted at the front side of the base screed G, the lateral position of the transition 5 between the lane 3 and the slope 4 may be set at each arbitrary location between the outer end of the sole plate 6 of the base screed G and the middle of the base screed G and is maintained stationary at this location, as shown in FIGS. 2 and 6. The respective other extension screed A which does not form a slope 4 e.g. is adjusted such that the sole plate 7 of this extension screed A forms an edge portion of the lane 3 as a direct straight prolongation of the sole plate 6 of the base screed G.

FIG. 3 indicates that the towing point 2 of the towing bars 1 can be adjusted in height direction in the direction of a double arrow 8 in order to vary an angle of attack of the paving screed E relative to the planum P, in order to vary the thickness of the paving mat. Both towing points 2 even may be adjusted into different height positions in order to vary the thickness of the paving mat M crosswise to the travelling direction R.

A detailed embodiment of the paving screed E which only is shown schematically in FIGS. 1, 3 and 5 will be explained with the help of FIGS. 7 and 8. The paving screed E is working during the laying of the paving mat M such that the lateral position of the transition 5 relative to the base screed G is automatically held stationary with respect to the base screed G exclusively by executing simple height measurements substantially perpendicular to the planum P, by evaluating the result of the measurements, and by converting the respective measurement result into actuation command signals for a respective height adjustment assembly of the extension screed E, and finally by a regulated automatic adaptation of the height position of the sole plate 7 of the extension screed A.

Figure 7:
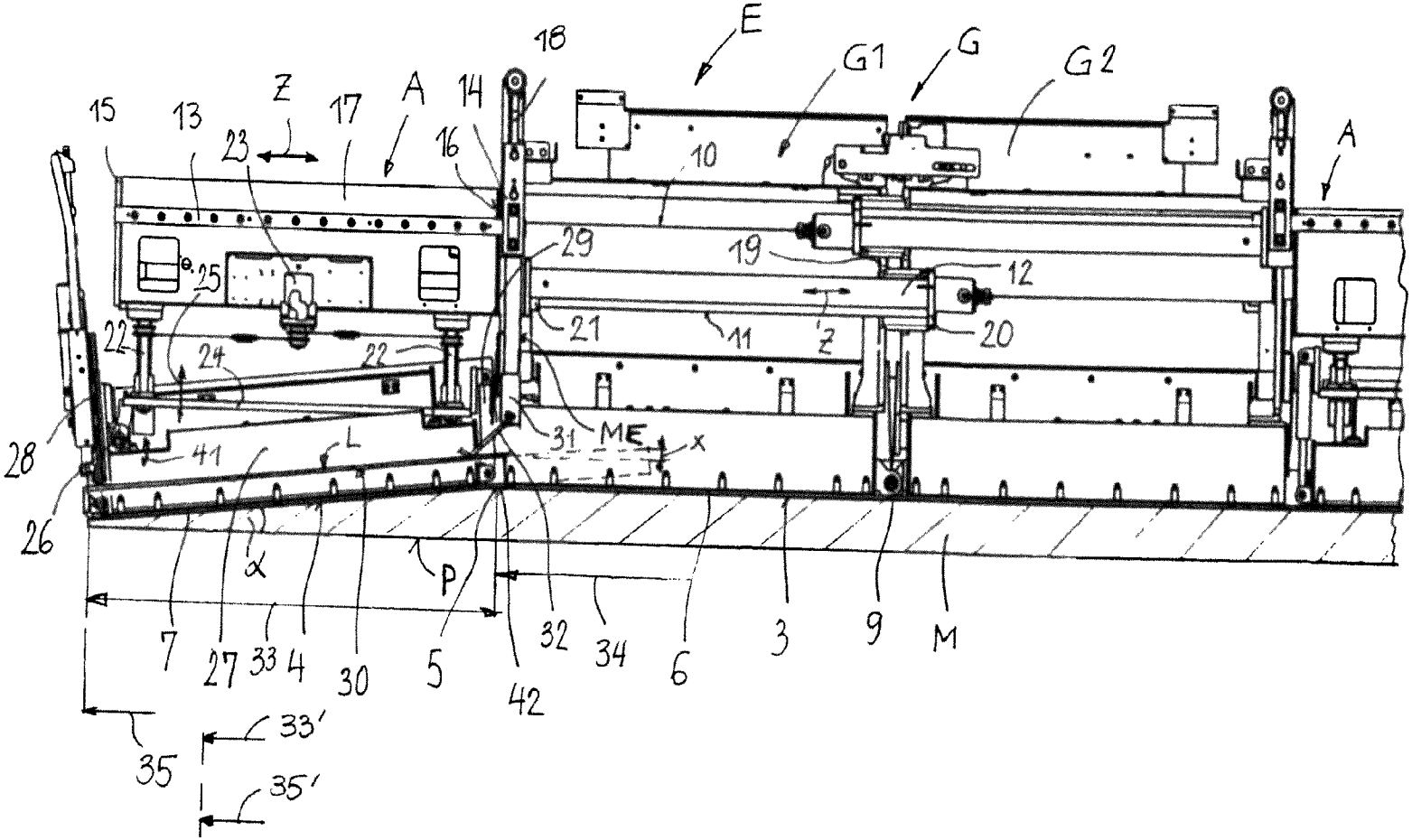

The paving screed E shown in FIG. 7 in a rear view comprises a base screed G having two substantially symmetric base screed parts G1, G2 which are interconnected in a joint 9 oriented in travelling direction R. Thanks to the joint 9 the base screed parts G1, G2 may be aligned with respect to each other in order to form a planar surface of the lane 3, or may be tilted relative to each other (not shown) in order to form a crown profile. Provided that a slope 4 is formed at only one side of the lane 3, the opposite extension screed may form a planar edge portion of the lane 3. Alternatively, at both sides of the lane 3, slopes 4 may be formed in the paving mat M.

As the base screed parts G1, G2 and also the extension screeds A are equal or very similar to each other, only the base screed part G1 having the extension screed A on the left side will be explained referring to FIGS. 7 and 8.

Between inner and outer cheeks 18, 19 of the base screed part G1 a telescopic tube 10 and parallel but offset to the telescopic tube 10 a guiding tube 11 are fixed in the base screed part G1. The telescopic tube 10 and the guiding tube 11 define a guiding structure and also the sliding direction Z for the extension screed A parallel to the base screed G or the sole plate 6 of the base screed G, respectively. For sliding the extension screed A a hydrocylinder 12 is provided which is supported in a fixation 20 at the inner cheek 19 and which extends through the outer cheek 16 to an outer cheek 15 of the extension screed A. For additional guidance and suspension of the extension screed A against forces resulting from e.g. the drag resistance of the paving material B a guiding rail 13 is mounted at a rear side of an extension guiding structure 17 between the outside cheek 15 and an inner cheek 16 of the extension screed A. The guiding rail 13 is slidably engaging into a torque suspension 14 mounted at the outer cheek 18 of the base screed part G, e.g. between guiding rolls or guiding blocks of the torque suspension 14. A guiding body 20 is slidably arranged on the guiding tube 11. The guiding body 21 is connected to the inner cheek 16 of the extension guiding structure 17. The fixation 20 is arranged at the inner cheek 19 of the base screed part G1 and extends beyond the middle of the base screed G from the base screed part G1 beyond the middle over a certain length into the other base screed part G2. When the extension screed A is fully retracted (not shown), the guiding body 21 will be moved into the vicinity of the fixation 20 such that overall a sliding stroke of the extension screed A can be achieved which substantially corresponds to the half width of the base screed G. This allows to adjust a maximum working width 35 corresponding to the twofold width of the base screed G when both extension screeds A are fully extended, provided that each extension screed A or its sole plate 7 has a lateral width substantially corresponding to the lateral width of each base screed part G1, G2.

Figure 8:
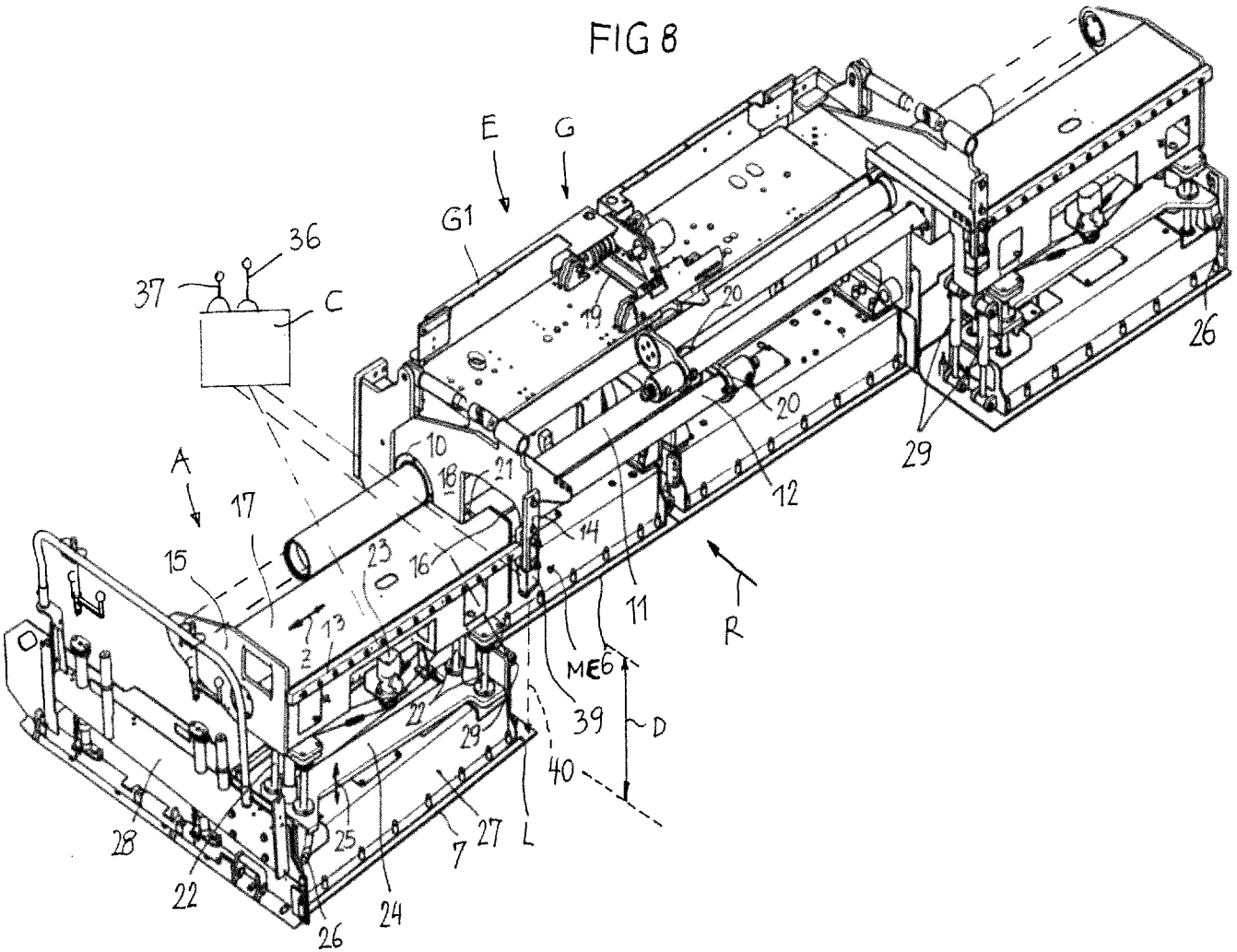

The sole plate 7 of the extension screed A is mounted, preferably exchangeable, at a box shape frame 27 and can be tilted by actuators 29 in lateral direction about a pivot hinge 26. The pivot hinge 26 is arranged at a horizontal intermediate frame 24 at which intermediate frame the actuators 29 are suspended which engage at the frame 27. Between the intermediate frame 24 and the extension guiding structure 17 two height adjustment assemblies 22 (e.g. screw spindles) are provided with a distance in sliding direction Z in-between. The height adjustment assemblies 22 allow to adjust the height position of the sole plate 7 of the extension screed A relative to the extension guiding structure 17 and relative to the base screed G. The height adjustment assemblies 22 e.g.

have a common drive 23 which is in functional connection with a control device C indicated in FIG. 8. The height adjustment assemblies 22, when actuated, move the intermediate frame 24 and thus the sole plate 7 of the extension screed A in the directions of a double arrow 25. An edger plate 28 is mounted at the outer end of the frame 27 (or alternatively, a not shown screed extension part, in order to allow to form an even wider slope 4).

In order to maintain the lateral position of the transition 5 automatically relative to the base screed G in case of a variation of the working width 35, a height measuring device ME is interlinked with an e.g. computerised regulating system of the paving screed E, which e.g. is contained in the control device C. The height measuring device ME measures a height difference D substantially perpendicular to the planum P between the sole plate 6 of the base screed G and the sole plate 7 of the extension screed A (FIG. 8). The height measuring device ME e.g. comprises a measuring apparatus provided in FIG. 7 at the outer cheek 18 of the base screed part G1. The measuring apparatus delivers an actuating signal for the height adjustment assemblies 22. The measuring apparatus comprises a mechanical height feeler forming a measuring member 32 e.g. riding on a reference line L which is parallel to the sole plate 7 of the extension screed A. The reference line L e.g. may be constituted by a ruler 20 which is fixedly mounted either at the rear edge region of the sole plate 7 of the extension screed A or at an arbitrary location of the frame 27.

In the fully extended position of the extension screed A as shown in FIG. 7, and provided that the angle α of slope 7 is set about the pivot joint 26 by the actuators 29, the lateral position of the transition 5 is situated directly at the outer end of the sole plate 6 of the base screed G which outer end is associated to the extension screed A forming the slope 4. The height difference D measured by the measuring member 32 is stored in this condition as a target value. If then the working width 35 e.g. has to be varied to the reduced working width 35' (FIG. 7), which is executed by an actuation of the hydrocylinder 12, the extension guiding structure 17 is moved inwardly in relation to the base screed part G1. In this case the measuring member 32 detects a deviation from the target value, as the inclined sole plate 7 of the extension screed A is moved in sliding direction Z parallel to the sole plate 6 of the base screed part G1, and since the measuring member 32 riding on the reference line L is now detecting another, lower location at the reference line L. The measured deviation is converted into an actuating signal for the drive 23 of the height adjustment assemblies 22, in order to immediately lift the intermediate frame 24 corresponding with the measured deviation such that during the sliding motion of the extension screed A the lateral position of the transition 5 is maintained at the end 42 of the sole plate 6 of the base screed part G1. When the extension screed A is moved inwardly, the width 33 of the slope 4 is reduced to a new width 33'. While the width 34 of the lane 3 remains unchanged. If at a later point in time the extension screed A is again extended for a further variation of the working width 35, the measuring member 32 again measures the deviation from the target value. The actuation signal derived from the measured deviation is then used, immediately and synchronously with the extension movement to actuate the height adjustment assemblies 22 via the drive 23 such that the intermediate frame 24 and thus the sole plate 7 of the extension screed A are lowered correspondingly, and such that again the lateral position of the transition 5 remains stationary.

In the perspective illustration of the paving screed E in FIG. 8 another sort of a height measuring device ME is indicated. Here the measuring member 39 is operating without contact with the reference line LO and is a height sensor which is in signal transmitting connection with the control device C. The drive 23 and, preferably, the actuators 29 are either indirectly or directly connected to the control device C as well. In the case of a hydraulic layout of the paving screed E the drive 23 and the actuators 29 are connected to the control device C via control valves. In the case of an electric layout of the paving screed the drive 23 and the actuators 29 are connected to the control device C via circuitries. In this case the measuring member 39 may operate with a measuring ray 40, indicated by a dotted line, to detect the height difference D between the measuring location of the measuring member 39 fixed to the base screed G and the reference line L. The reference line L, in this embodiment, may be formed by the upper side of the rear edge of the sole plate 7 of the extension screed A.

The control device C e.g. contains an automatic regulating system which correspondingly controls the drive 23 with the help of the measured deviation from the target value or by the actuating signal, in order to maintain the lateral position of the transition 5 by an immediate height adaptation when the working width is varied. The control device C may additionally be equipped with manually actuable devices 37, 36 in order to e.g. actuate only drive 23 or only the actuators 29. The drive 23 may even be controlled manually in the case that e.g. the automatic regulation for maintaining the lateral position of the transition 5 stationarily does not operate sufficiently precisely, e.g. in the case that the operator of the road paver or personnel situated at the paving screed should visually detect a lateral of the transition 5 in the laid paving mat M to one or the other side.

The automatic regulation for maintaining the lateral position of the transition 5 stationary operates also in the case of a variation of the angle α of the slope 4, e.g. caused by actuation of the actuators 29 which correspondingly incline the frame 27 in the pivot joint 26. Also in this case the height difference D is measured by means of the height measuring device ME, and the drive 23 will be controlled correspondingly in order to correct a measured deviation from the target value by a height adaptation in the case of the variation of the angle α.

In order to calibrate the regulating system first the lateral position of the transition 5 is set to a desired location of the sole plate 6 of the base screed G, preferably at the location of the end 42, by adjusting the angle α by means of the actuators 29 and/or by a corresponding actuation of the drive 23 for the height adjustment assemblies 22. The value of the then measured height difference D is used as the target value for the further regulation, or is set to zero. This means that the lateral position, so to speak, is fixed in terms of the regulating technology solely by means of the height difference D. Further current operating conditions at the paving screed E, like the sliding position of the extension screed A, the angle of attack of the paving screed E relative to the planum P, the angle of the inclination of the road paver F, the height positions of the towing points 2 at the road paver F, and the like, are ignored for the automatic regulation since the regulating system operates solely by continuously measuring and monitoring the height difference D. For the automatic regulation, expediently, the linear speed of the displacement of the extension screed A in sliding direction Z and the linear speed of the height adjustment in the direction of the double arrow 25 substantially perpendicular to the planum P are matched with respect to each other so that the lateral position of the transition 5 is maintained automatically. That calculating operation e.g. is executed depending on the angle α, or, preferably, with a tangent of the angle α. This means that the ratio between both linear speeds is set during the regulation corresponding to the gradient of the angle α (and is only varied in the case of a variation of the angle α correspondingly). This type of regulation only needs very simple calculation operations, the simple and reliable height measuring device ME, and a simple regulating system.

The further components of the paving screed E perspectively shown in FIG. 8 correspond to the components already described with reference to FIG. 7.

In FIG. 7 the measuring member 32 is a pivotable mechanical height feeler. Instead of the measuring member 32 in the form of a pivotable height feeler in FIG. 7 a measuring member 32 could be used which slides along the reference line L. The measuring member is then held with respect to the base screed G in sliding direction Z and is moved when the reference line L moves in sliding direction Z parallel to the base screed G correspondingly upwardly or downwardly in order to detect the height difference D. The detected height difference or the deviation of the height difference is then transmitted to the measuring location fixed at the base screed G or to the measuring apparatus. The reference line L may be arranged at any arbitrary location of the extension screed A at the frame 27, provided that the reference line L extends parallel to the sole plate 7 of the extension screed A, more precisely parallel to the lower rear edge (in travelling direction R) of the sole plate 7. In a not shown alternative of the paving screed E the sole plate 7 of the extension screed A is not inclined laterally together with the frame 27 about the pivot joint 26 about the pivot joint 26, but only the sole plate 7 of the extension screed A is laterally inclined relative to the frame 27. In this case the height adjustment assemblies 22 directly engage at the frame 27. The intermediate frame 24 is then dispensed with.

The invention claimed is:

1. A method for laying a paving mat of paving material on a planum with a paving screed being towed floatingly in travelling direction on the paving material by a road paver, the paving mat comprising a lane of a determined width and at least one sideward slope, the slope being inclined downwardly with an angle ($\alpha$) from the transition to the outside, the paving screed including a base screed and at least one extension screed which is mounted at the front side or the rear side of the base screed and is slidable lateral to the travelling direction substantially parallel to the base screed for varying a working width, the base screed and the extension screed each having a sole plate, the sole plate of the extension screed being inclined laterally with the angle of the slope relative to the sole plate of the base screed, according to which method upon varying the working width by sliding the laterally inclined extension screed relative and parallel to the base screed and/or upon varying of the angle of the slope by laterally tilting the sole plate of the extension screed relative to the sole plate of the base screed, the sole plate of the extension screed being adjustable in height direction relative to the base screed by means of at least two height adjustment assemblies which are distant from each other in sliding direction of the extension screed in order to maintain the predetermined lateral position of the transition, comprising the following steps:

measuring a height difference substantially perpendicular to the planum between a fixed measuring location at the base screed and a location along a reference line fixed at the extension screed, which reference line is parallel to the laterally inclined extension screed and the slope, performing the measuring step during after setting the lateral position of the extension screed, storing the measured height difference as a target value, measuring a deviation of the height difference from the target value caused by the variation while the paving mat is laid, actuating the height adjustment assemblies corresponding to the measured deviation to correct the deviating height difference to the target value exclusively by an automatic height adaptation of the sole plate of the laterally inclined extension screed.

2. The method defined in claim 1, which comprises measuring the height difference and/or the deviation from the height difference with a measuring member fixed at the base screed of a height measuring device.

3. The method defined in claim 1, which comprises measuring the height difference and/or the deviation of the height difference with a height measuring device which comprises a measuring member which is height adjustable relative to the fixed measuring location at the base screed and slides along the reference line of the extension screed while being held stationary relative to the base screed in the sliding direction of the extension screed.

4. The method defined in claim 1, which comprises measuring the height difference at or close to an end of the sole plate of the base screed which end is associated to the respective extension screed.

5. The method defined in claim 1 which comprises measuring the height difference at or close to the rear edge of the sole plate of the extension screed, or of the sole plate of the base screed, seen in travelling direction.

6. The method defined in claim 3, which comprises providing a ruler as the reference line, arranging the ruler either in a stationary position at the extension screed or the sole plate of the extension screed, and mechanically measuring the height difference with a height feeler, and locating the height feeler at the base screed and delivering a signal from the height feeler to actuate the height adjustment assemblies in the extension screed.

7. The method defined in claim 1, which comprises measuring the height difference to the respective location along the reference line with a measuring member formed as an electronic height sensor, and converting the measured height difference into an actuation signal for the height adjustment assemblies in the extension screed.

8. The method defined in claim 1, which comprises matching the linear speed of the sliding displacement of the extension screed in the sliding direction and the linear speed of the height adjustment assemblies at least substantially perpendicular to the planum in relation to each other for a simultaneous height adaptation of the sole plate of the extension screed, and to hold the lateral position of the transition stationary when varying the working width.

9. The method defined in claim 1, which comprises manually or remotely correcting a deviation from the target value of the height difference which has not been completely corrected by the automatic height adaptation of the sole plate of the extension screed with the height adjustment assemblies.

10. The method defined in claim 1, which comprises setting, the lateral position of the transition substantially at the end of the sole plate of the base screed associated with the respective extension screed, and holding the lateral position at the end of the base screed sole plate.

11. The method defined in claim 1, which comprises the paving screed having the respective extension screed at the front side of the base screed and setting and holding the lateral position of the transition at a selectable location between the end of the sole plate of the base screed associated with the respective extension screed, and the middle of the sole plate of the base screed.

* * * * *